United States Patent [19]

Matsumoto et al.

[11] Patent Number: 4,484,406

[45] Date of Patent: Nov. 27, 1984

[54] CONNECTED PRISM ELEMENTS SWIVELLINGLY

[75] Inventors: Takao Matsumoto, Tokyo; Hajime Matsumoto, Chiba, both of Japan

[73] Assignee: Toybox Corporation, Tokyo, Japan

[21] Appl. No.: 368,830

[22] Filed: Apr. 15, 1982

[30] Foreign Application Priority Data

Apr. 27, 1981 [JP] Japan ..... 56-61060[U]

[51] Int. Cl.[3] ..... A63H 33/00

[52] U.S. Cl. ..... 446/487; 273/153 S; 403/96

[58] Field of Search ..... 46/1 R, 16, 22, 23, 46/26, 29; 403/96, 97; 273/157, 153 S

[56] References Cited

U.S. PATENT DOCUMENTS

| | | | |
|---|---|---|---|
| 1,068,679 | 7/1913 | Lortz | 403/96 |
| 2,877,506 | 3/1959 | Almoslino | 46/26 X |
| 3,222,072 | 12/1965 | Dreyer | 273/157 |
| 3,367,063 | 2/1968 | Bondesson et al. | 46/26 |
| 3,597,872 | 8/1971 | Vennola | 46/1 R |
| 4,026,065 | 5/1977 | Dick | 46/26 X |
| 4,377,916 | 3/1983 | Komiya | 46/1 R |
| 4,392,323 | 7/1983 | Rubik | 46/1 R |

FOREIGN PATENT DOCUMENTS

| | | | |
|---|---|---|---|
| 7005541 | 2/1970 | Fed. Rep. of Germany | 46/24 |

*Primary Examiner*—F. Barry Shay

*Attorney, Agent, or Firm*—Staas & Halsey

[57] ABSTRACT

An amusement device consisting of a manipulative puzzle having a plurality of hollow prism-shaped pieces rotatably connected by swivel joints. Each swivel joint comprises a base centrally formed in a wall of one prism and inserted through a hole located in a confronting wall of an adjacent prism. The base is secured by a screw passing through a washer fitting over the swivel joint base. In addition, a set of projections fit into corresponding depressions located on the respective confronting walls to hold the prisms in place until moved. An infinite number of configurations may be imparted to the puzzle by manipulating the prisms, however, it is preferred that the player manipulate an elongated rectangular shaft of interconnected prisms to attain a substantially spherical configuration.

3 Claims, 7 Drawing Figures

CONNECTED PRISM ELEMENTS SWIVELLINGLY

BACKGROUND OF THE INVENTION

This invention relates to an amusement device. More particularly, this invention relates to a manipulative puzzle having a series of rotatably connected prism-shaped parts for forming various shapes.

Manipulative puzzles have recently been very popular with people of all ages, especially children. To be popular, the design of these amusement devices must capture the interest of the player, must challenge the player's intellectual curiosity and maintain that curiosity for a reasonable amount of time, must be entertaining for various age groups, and must be durable and relatively simple in design to be long-lasting and safe.

SUMMARY OF THE INVENTION

Accordingly, it is a primary object of this invention to provide a manipulative puzzle having various interconnected pieces which may be moved to form an almost infinite number of shapes, thereby capturing and maintaining the interest and intellectual curiosity of the player.

It is another object of this invention to provide a manipulative puzzle which requires concentration, imagination and planning, and thus is entertaining for people of all ages.

Still another object of this invention is to provide a manipulative puzzle with the features set forth above which is made of durable plastic and relatively simple in design and construction to ensure long-lasting and safe play, especially for children.

Finally, it is an object of this invention to provide a puzzle which begins as an elongated rectangular shaft of interconnected prisms manipulated to finally form a substantially spherical configuration. Attaining substantially spherical configuration acts as the completion of the puzzle and a reward to the player.

Additional objects and advantages of the invention will be set forth in part in the description which follows, and in part will be obvious from the description, or may be learned by practice of the invention. The objects and advantages of the invention may be realized and obtained by means of the instrumentalities and combination particularly pointed out in the appended claims.

To achieve the foregoing objects and in accordance with the purpose of the invention, as embodied and broadly described herein the amusement device comprises a series of interconnected prism-shaped objects wherein manipulation of individual prisms imparts different shapes to the puzzle.

In the preferred embodiment of the amusement device, there is included a series of hollow prism-shaped objects having two right-triangle sides, a rectangular base and two square sides. The prisms are connected at the square sides by swivel joints. The swivel joints have a swivel joint base extending outwardly from one wall of a prism. The swivel joint base has a circular bottom and a square top. The base is inserted through a centrally located hole in the wall of an adjacent prism and a broad-headed screw is placed through a washer fitting around the square top of the swivel joint base, and the screw is then secured into the swivel joint base.

The prisms are designed in alternating colors and are originally aligned to form an elongated rectangular shaft. Due to the action of the swivel joint, each prism is capable of turning 360 degrees in relation to the prism adjacent thereto. By manipulating the variously colored prisms the player can transform the elongated rectangular shaft into a substantially spherical shape.

BRIEF DESCRIPTION OF THE DRAWINGS

The accompanying drawings, which are incorporated in and constitute a part of this specification, illustrate the invention and, together with the description, serve to explain the principles of the invention.

DETAILED DESCRIPTION OF THE PREFERRED EMBODIMENT

Figure 1:
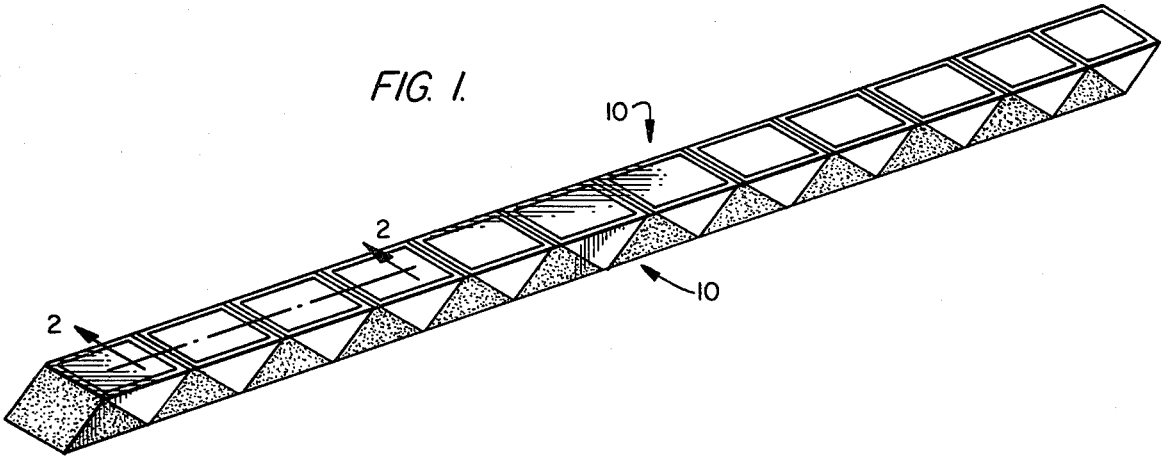
FIG. 1 is a perspective view of a preferred embodiment of the manipulative puzzle in accordance with the present invention, generally illustrating the differently colored prisms aligned in an elongated rectangular shaft.

Reference will now be made in detail to the present preferred embodiment of the invention, an example of which is illustrated in the accompanying drawings.

In accordance with the invention, the amusement device comprises a series of adjacent prisms connected by swivel joints, wherein each prism can be moved individually. As embodied and shown in FIGS. 1 and 2, the reference numeral 10 designates a hollow prism preferably made of a plastic, and swivel joints 12.

Figure 3:
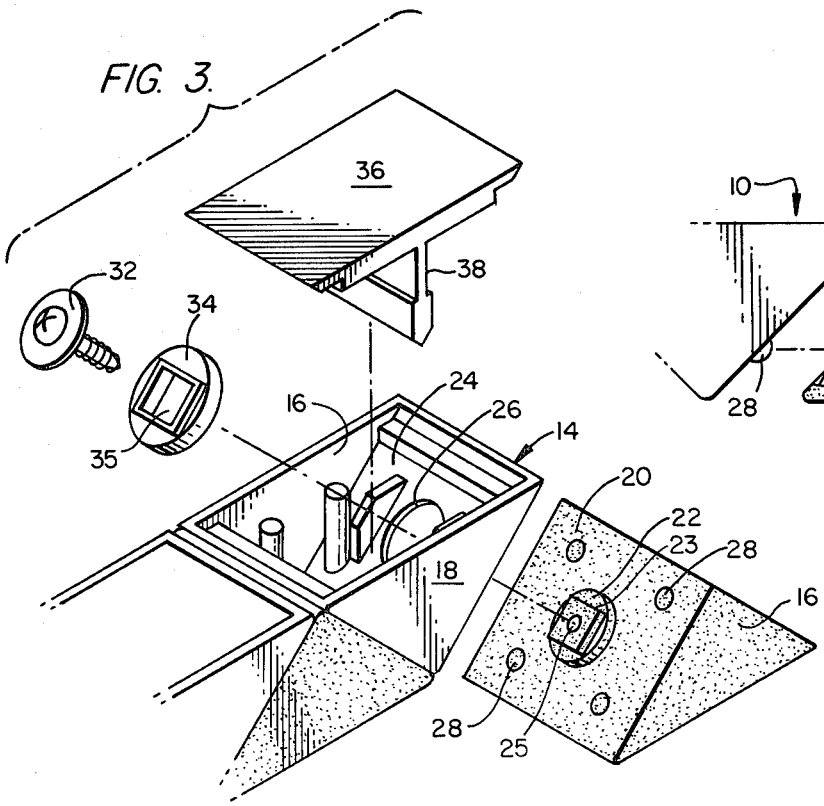
FIG. 3 is a perspective view illustrating in particular the parts of the swivel joint and the separate prism cover.

As best seen in FIG. 3, each hollow prism 10 includes an open-shaped prism body 14 with two parallel right triangle sides and a removable rectangular-shaped base 36, which will be described more fully hereinafter. One of these sides is denoted the left triangular side 16 and, accordingly, the other is the right triangular side 18. In addition, the prism body 14 has a front square side 20 to which is integrally molded a swivel joint base 22. The swivel joint base 22 has a circular end molded integrally to the front square side 20, and a square top. The rear square side 24 contains a circular hole 26 large enough to accept therethrough the swivel joint base 22.

Each prism is connected to an adjacent prism by confronting the front square side 20 of one prism to the rear square side 24 of another prism. When confronted, the swivel joint base 22 portion of the swivel joint located on the front square side 20 fits into the hole 26 located in the rear rectangular side 24 of the adjacent prism.

Figure 4:
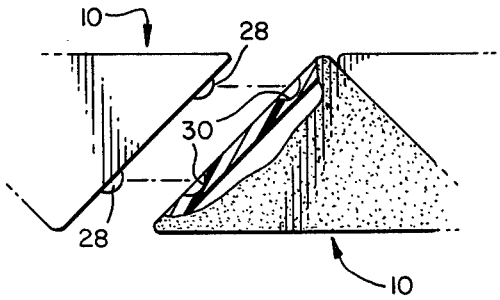
FIG. 4 is a side view illustrating in particular the relationship between the semispherical projections and recesses located on the walls of adjacent prisms.

As best seen in FIGS. 3 and 4, the front square side 20 also contains four integrally molded semispherical projections 28. Correspondingly, the rear square side 24 contains four integrally molded semispherical recesses 30. When the front and rear sides, 20 and 24, of two adjacent prisms are confronted, the four semispherical projections 28 fit into the four semispherical recesses 30. This fit keeps adjacent prisms in locked relationship until the player chooses to change the orientation of the prisms. When one prism is rotated, the projections 28 leave the recesses 30 and move along rear square side 24 until they again fit into the recesses 30.

In this configuration, each prism is connected to adjacent prisms at two points, one on its front side 20 and one its rear side 24. The exception to each prism having two joints is the prisms forming the ends of the puzzle. One of the end prism pieces is connected only at its front square side 20 by a swivel joint 12. This prism's rear square side 24 is not like the rear square sides 24 of internal prisms, i.e., a side with a hole 26 at its center to receive a swivel joint base 22 from an adjacent prism. Instead, it is a solid-surfaced side having only the four semispherical projections 28 extending from its surface. The prism forming the other end of the puzzle is connected to its adjacent prism only at its rear side 24. Similarly, this prism's front square side 20, is not like the front square sides 20 of internal prisms, i.e., a side with a swivel joint base 22 at its center. Instead, it is a solid-surfaced side having only the four semispherical depressions 30 in its surface.

Figure 7:
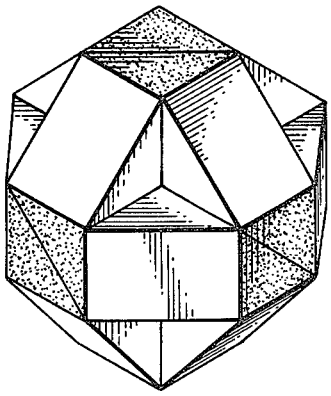
FIG. 7 is the substantially spherical configuration which can be imparted to the manipulative puzzle.

When the puzzle is manipulated to form the desired configuration shown in FIG. 7, the front square side 20 of one end prism necessarily confronts the rear square side 24 of the other end prism. The projections 28 and depressions 30 located on the respective front and rear sides 20 and 24 serve to hold in place the confronting front side 20 of one end prism against the rear side 24 of the other end prism.

As stated, connecting each prism to the adjacent prism is a swivel joint 12. As best seen in FIG. 3, each swivel joint comprises a cylindrical swivel joint base 22 having a square projection 23 formed thereon with a small hole 25 formed centrally therein. The cylindrical swivel joint base 22 fits fully within a hole 26 of the rear square side 24 of an adjacent prism, since the diameters of the cylindrical swivel joint base 22 and the hole 26 are substantially similar. A screw 32 with a broad, circular head whose diameter is at least as great as the shortest distance between two opposing sides of the square projection 23, has its threaded area passed through a washer 34 having a greater diameter than either the swivel joint base 22 or the hole 26 and having a square hole 35 formed centrally therein. The square hole 35 in the washer 34 closely fits around the square projection 23 on the top of the swivel joint base 22. The screw 32 is finally screwed into the hole 25 formed in the square projection 23.

The final side of the prism is made of a removable, rectangular base 36 having a centrally perpendicular flange 38. This perpendicular flange 38 extends from the prism base 36 to the top of the prism body 14. The perpendicular flange 38 is formed such that its end fits into the pointed area of the top of the prism. Alternatively, flanges may be formed at the top of the prism body to rest laterally of the base flange 38. Typically, a glue suitable for securing plastics is used where the base flange 38 touches the top of the prism body.

Figure 2:
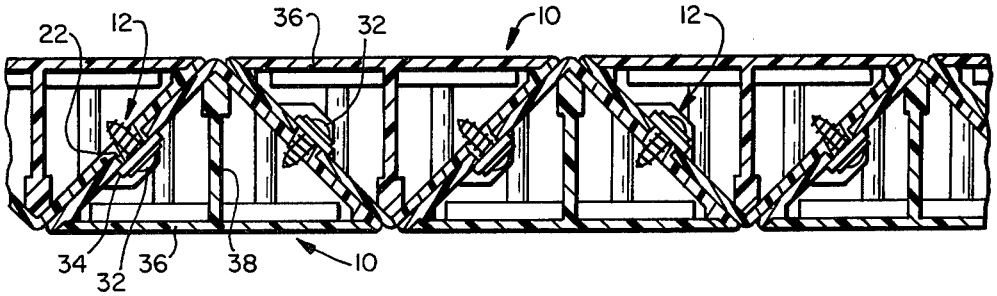
FIG. 2 is a cross-sectional view of a portion of the manipulative puzzle shown in FIG. 1, illustrating in particular the series of swivel joints connecting the prisms.

Preferably, twenty-four prisms are connected in a series to form an elongated shaft. The individual prisms are arranged originally such that the base of each prism is in a substantially parallel plane to that of all other prism bases, as shown in FIG. 1. In this configuration, the prisms alternate between resting on their base or being inverted, i.e., resting on the point opposite the base. Thus, with twenty-four prisms, twelve are resting on their base and twelve are alternatively spaced and rest on their point.

Also in the preferred embodiment, the color of each prism is different from adjacent prisms. Thus, with twenty-four prisms, the twelve resting on their base are one color, and the twelve resting on their point are another color.

To begin using the manipulative puzzle of the present invention the player usually begins with the puzzle in the configuration seen in FIG. 1, i.e., the elongated rectangular shaft. The player can move at any one time up to twelve prism pieces together. However, the player usually turns one prism piece at a time.

Figure 5:
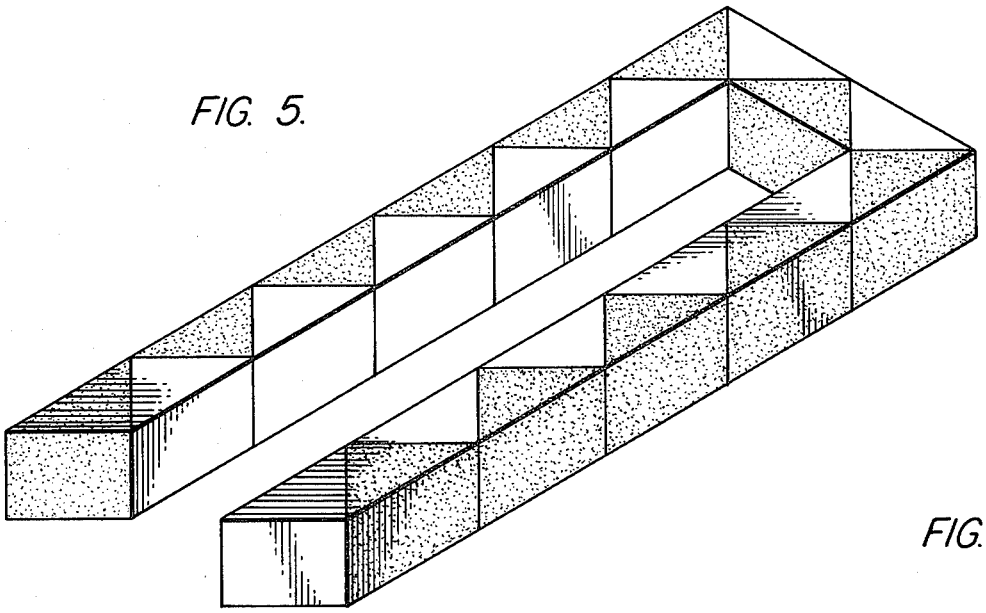
FIG. 5 is a perspective view of one of the shapes which can be imparted to the manipulative puzzle.
Figure 6:
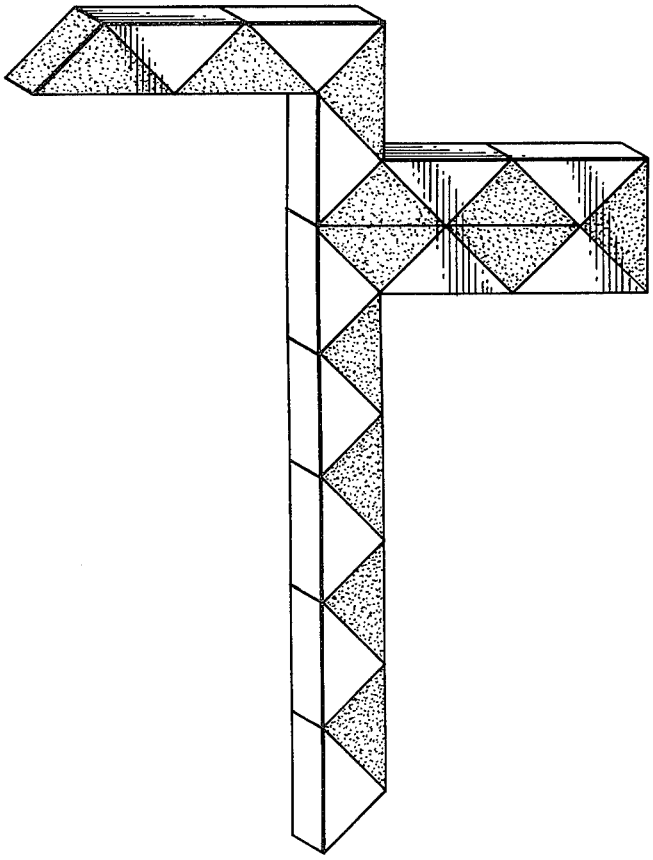
FIG. 6 is another shape which can be imparted to the manipulative puzzle.

When the player begins manipulating the prisms, he has in mind attaining the substantially spherical configuration as depicted in FIG. 7. During the attempt to produce the shape depicted by FIG. 7, the player is capable of producing an almost infinite number of configurations. Examples of these configurations are shown in FIGS. 5 and 6. Of course, after attaining the desired configuration, the player may further manipulate the puzzle to return to the elongated rectangular shaft configuration shown in FIG. 1.

Three factors taken together provide the puzzle of the present invention with the characteristics that it be fairly flexible and easy to manipulate: it is constructed preferably from plastic; the design of the swivel joint offers some amount of flexibility to the entire puzzle; and between the adjacent faces of the prism there is located a bit of grease.

In view of the foregoing written description of the preferred embodiment and accompanying drawings it is seen that the combination of prisms and swivel joints can be manipulated in such a way that various unique and different shapes or configurations of a puzzle may be formed. It is further seen that the manipulative puzzle of the present invention can have its shape changed for easy storage or carrying, and is relatively simple in construction and can be formed of plastic for durability and safety, for especially the children playing with the device. In addition, the almost infinite number of configurations the puzzle is capable of producing, peaks the players' curiosity. It will be apparent, however, to those skilled in the art that modifications and variations could be made in the manipulative puzzle in accordance with the teachings of the invention without departing from the spirit or scope of the invention. Thus, it is intended that the present invention cover the modifiations and variations of this invention within the scope of the appended claims and their equivalents.

What is claimed is:

1. An amusement device, comprising:

(a) a plurality of hollow prisms rotatably connected in a series;

(b) each prism having two right angled triangular sides in parallel planes, a rectangular base, and first and second square sides, wherein the first square side is the front of the prism, the second square side is the rear of the prism and the prisms are connected in front-to-rear abutting relation;

(c) a plurality of substantially semi-spherical projections formed on the outer surface of each abutted first square side;

(d) a cylindrical swivel joint base extending fom the center of the outer surface of each abutted first square side, wherein each abutted swivel joint base has a square projection located thereon with a first hole formed centrally therein;

(e) a plurality of depressions formed on the outer surface of each abutted second square side;

(f) a second hole formed at the center portion of each abutted second square side, wherein the second hole diameter is substantially similar to the diameter of the cylindrical swivel joint base such that the second hole is capable of flushly receiving a said cylindrical swivel joint base;

(g) a washer having a diameter greater than the diameter of the second hole and having a third hole formed therein which is square-shaped and is capable of flushly receiving the square projection formed on the swivel joint base; and (h) a screw having a head diameter greater than the distance between two opposing sides of the third hole, wherein when the cylindrical swivel joint base of a first prism is received flushly by the second hole of a second prism and the square projection on the cylindrical swivel joint base of the first prism is received flushly by the third hole of the second prism, the threaded area of the screw passes through the third hole of the second prism and into the first hole formed in the first prism, such that rotation of the first prism relative to the second prism rotates the screw and washer in unison therewith.

2. The amusement device as described in claim 1, wherein the number of prisms connected in series is twenty-four.

3. The amusement device as described in claim 1, wherein each prism is a color different from the directly adjacent prisms.

* * * * *